US007709713B1

(12) United States Patent
Pearce et al.

(10) Patent No.: US 7,709,713 B1
(45) Date of Patent: May 4, 2010

(54) MOUNTING PLATE AND VIBRATO ASSEMBLY FOR VIBRATO SYSTEM ON A GUITAR

(76) Inventors: Fred L. Pearce, P.O. Box 5331, Woodland Park, CO (US) 80866; Sherry L. Pearce, P.O. Box 5331, Woodland Park, CO (US) 80866

( * ) Notice: Subject to any disclaimer, the term of this patent is extended or adjusted under 35 U.S.C. 154(b) by 17 days.

(21) Appl. No.: 11/821,819

(22) Filed: Jun. 27, 2007

(51) Int. Cl.
*G10D 3/00* (2006.01)

(52) U.S. Cl. ..... 84/313; 84/299

(58) Field of Classification Search ..... 84/313, 84/298, 299, 307, 312 R
See application file for complete search history.

(56) References Cited

U.S. PATENT DOCUMENTS 3,407,696 A * 10/1968 Smith et al. ..... 84/297 R
3,422,509 A * 1/1969 Porter ..... 84/313
3,500,711 A * 3/1970 Fender ..... 84/313

* cited by examiner

*Primary Examiner*—Jianchun Qin
(74) *Attorney, Agent, or Firm*—G. F. Gallinger

(57) ABSTRACT

A vibrato mounting bracket for a guitar, said vibrato unit having a frame having: a) a generally flat central portion extending from a bottom peripheral edge portion of the guitar, said flat central portion having four vibrato, unit attachment openings therethrough; b) a bottom portion extending from the central portion over the bottom peripheral edge portion of the guitar and having a lower strap screw attachment opening therethrough; and, c) an upper portion extending above the central portion having two opposite lateral openings therethrough spaced to align with i) the two outer string stop bar screws on the guitar, or ii) the two outer bridge attachment screws on the guitar where said guitar has a bridge attachment screw, or iii) the bridge height adjustment screws. The front face and the sound box are then better able to vibrate thereby producing maximum resonance and depth of sound.

18 Claims, 1 Drawing Sheet

MOUNTING PLATE AND VIBRATO ASSEMBLY FOR VIBRATO SYSTEM ON A GUITAR

FIELD OF THE INVENTION

This invention relates to vibratos used on stringed instruments. More particularly this invention relates to an improved method of vibrato construction and/or mounting on a guitar. The apparatus and method greatly enhance resonance in a guitar by alleviating dampening pressure on the front face of the guitar.

BACKGROUND OF THE INVENTION

The inventor herein is a musician. He initially developed a vibrato mounting bracket for his guitar after he became aware that he would substantially devalue his guitar if he mounted a vibrato unit on the guitar. Drilling holes and turning screws into his $40,000 guitar to mount the vibrato unit directly thereon, would devalue the guitar by $6000. Accordingly, he developed a mounting bracket which carried the vibrato unit. The mounting bracket was attached to his guitar solely by the lower shoulder strap connection screw, as well as at a top of the bracket by the outer two string stop bar screw attachments on the guitar. He observed that his vibrato bracket guitar sounded substantially better than vibrato guitars to which the vibrato unit was directly mounted thereon.

The inventor attributed this improved sound quality and volume to the clamping effect which the vibrato unit had on the front face of the guitar. He subsequently further developed his mounting bracket, each bracket further reducing upward pulling and downward pressure on the front face of the guitar. The conventional vibrato, directly attached to the front face of the guitar, draws the highly tensioned strings of the guitar down thereby centrally lifting the front face of the guitar up, effectively dampening vibration on the central and entire front face of the resonating sound box of the guitar. The inventor's system resists string pull from the bottom of the guitar. Additionally the angle on which the strings are pulled down from the bridge of the guitar has also been refined so that the direction of string pull is towards a point above the bottom of the front face of the guitar. The downward component of force on the front face of the guitar is thereby even further reduced. With the use of this type of a mounting a bracket smaller inexpensive guitars have a sound box which produces substantially more resonance, depth and volume than the most expensive guitars having a vibrato directly unit directly mounted thereon. The sound volume is generally doubled with the use of the bracket. Sound sustain, the duration of vibration is also substantially increased. Sound attack, the speed which sound resonates from the guitar was also speeded. Improving sound attack, particularly in concert performances, reduces confusion caused by a multi-second delay. The quality and depth of sound with the herein disclosed vibrato mounting system on even an inexpensive guitar far surpasses anything available with any conventionally mounted vibrato unit on even the most expensive guitar.

Conventional vibrato units are most preferably mounted down, rearwardly as far as possible on the guitar, sacrificing operability, but thereby reducing downward clamping force on the face of the guitar. With the unit disclosed herein, the vibrato unit can be shifted upwardly on the guitar, allowing the vibrato arm to be more easily grasped and operated.

OBJECTS OF THE INVENTION

It is an object of this invention to disclose a mounting bracket for a vibrato unit which attaches to the guitar using only original screw anchor holes so that the guitar is not devalued by the mounting. It is an object of this invention to disclose a vibrato assembly for a guitar which utilizes only original screw anchor holes so that the guitar is not devalued by the mounting. It is an object of this invention to disclose a vibrato mounting assembly and/or bracket which applies minimal clamping pressure on the face of the guitar and thereby greatly enhances resonance, sound quality, sound volume, sound sustainability and sound attack. It is yet a further object of this invention to disclose a vibrato mounting bracket and/or assembly which facilitates more convenient access and greater operability of the vibrato arm. It is a final object of this invention to disclose a method of using the vibrato mounting bracket and/or vibrato assembly.

One aspect of this invention provides for a vibrato mounting bracket for mounting a vibrato unit on and above the a front face of a guitar, said vibrato unit having a frame having two lower mounting screw openings, two upper mounting screw openings, and carrying a lateral lower rotatable string anchoring member, and a tension arm assembly to rotate the rotatable lateral member, said bracket comprising: a) a generally flat central portion extending from a bottom peripheral edge portion of the guitar, said flat central portion having four vibrato unit attachment openings therethrough positioned to align with the openings on the vibrato unit; b) a bottom portion extending from the central portion over the bottom peripheral edge portion of the guitar and having a lower strap screw attachment opening therethrough; and, c) an upper portion extending above the central portion along the face of the guitar having two opposite lateral openings therethrough, said openings spaced to align with one of i) the two outer string stop bar screws on the guitar in all cases wherein said guitar has a screwed string stop bar, ii) the two outer bridge attachment screws on the guitar where said guitar has a bridge attachment screw and does not have a screwed string stop bar, and yet as another alternative with, iii) the bridge height adjustment screws were the guitar has a floating bridge and does not have a string stop bar. Then the vibrato unit is adequately attached to and minimally lifting/pressing on the front face of the guitar thereby consequently dampening vibration of the front face and sound box in the guitar. The front face and sound box maximally vibrate thereby producing maximum resonance and depth of sound. The vibrato unit is adequately secured to the guitar without devaluing the guitar by screwing to other than original screw attachment anchors therein.

In another aspect of this invention is a vibrato mounting assembly for producing vibrato on a guitar comprising: A) a frame portion having carrying a lateral rotatable string anchoring member, and a tension arm assembly to rotate the rotatable lateral member; and, B) a bracket portion. The bracket portion has a) a generally flat central portion carrying and having the frame portion attached thereto, said bracket portion extending from a bottom peripheral edge of the guitar along and over a front face of the guitar, b) a bottom portion extending from the central portion over the bottom peripheral edge portion of the guitar and having a lower strap bolt attachment opening therethrough; and, c) an upper portion extending above the central portion along the face of the guitar having two opposite lateral openings therethrough, said openings spaced to align i) most preferably with one of the two outer string stop bar screws on the guitar, ii) alternatively with the two outer bridge attachment screws on the guitar where said guitar has a bridge attachment screw and does not have a screwed string stop bar, and yet as another alternative, iii) the bridge height adjustment screws where the guitar has a floating bridge and does not have a string stop bar. Then when the bracket is attached to the guitar by the lower shoulder strap attachment screw the front face of the guitar is thereby minimally lifted/pressed and vibration on the front face of the guitar is consequently minimally dampened. The front face and sound box maximally vibrate thereby producing maximum resonance and depth of sound.

Various other objects, advantages and features of this invention will become apparent to those skilled in the art from the following description in conjunction with the accompanying drawings.

FIGURES OF THE INVENTION

Figure 1:
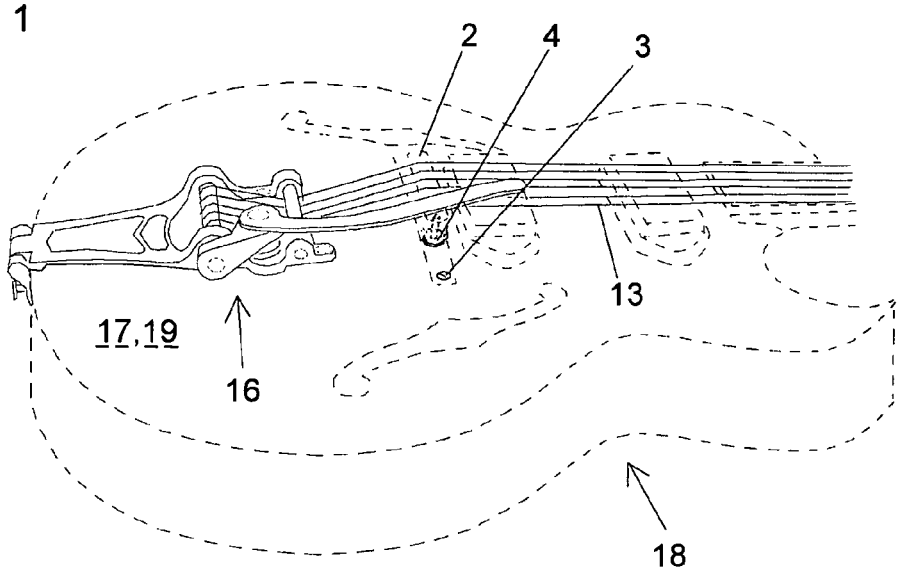
FIG. 1 is a perspective view of a guitar having a conventionally mounted vibrato unit thereon.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
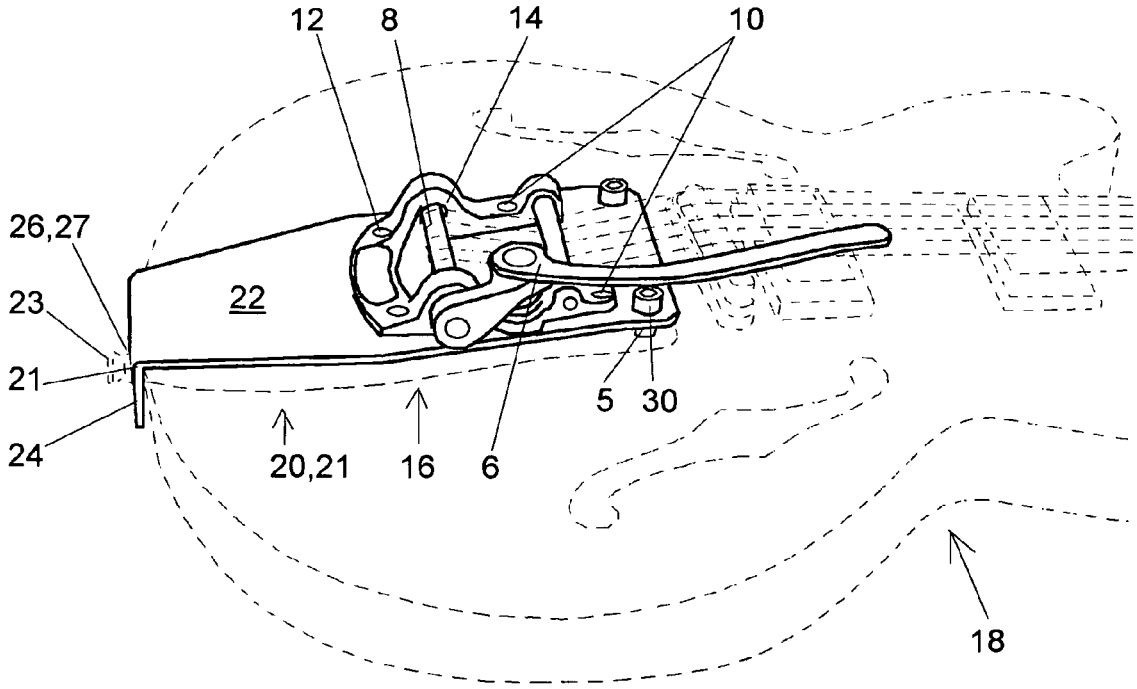
FIG. 2 is a perspective view of a guitar having a mounting bracket carrying a vibrato unit thereon.

Turning now to the drawings and more particularly to FIG. 1 we have a perspective view of a guitar 18 having a conventionally mounted vibrato unit 16 thereon. FIG. 2 is a perspective view of a guitar 18 having a mounting bracket 20 carrying a vibrato unit 16 thereon. One aspect of this invention provides for a vibrato mounting bracket 20 for mounting a vibrato unit 16 on and above the front face 17 of a guitar 18, said vibrato unit 16 having a frame 14 having two lower mounting screw openings 12, two upper mounting screw openings 10, and carrying a lateral lower rotatable string anchoring member 8, and a tension arm assembly 6 to rotate the rotatable lateral member 8, said bracket 20 comprising: a) a generally flat central portion 22 extending from a bottom peripheral edge portion of the guitar 20, said flat central portion 22 having four vibrato unit attachment openings 10,12 therethrough positioned to align with the openings 10,12 on the vibrato unit 16; b) a bottom portion 24 extending from the central portion 22 over the bottom peripheral edge portion of the guitar and having a lower strap screw attachment opening 26 therethrough; and, c) an upper portion 28 extending above the central portion 22 along the face of the guitar 18 having two opposite lateral openings 30 therethrough, said openings 30 spaced to align with one of i) the two outer string stop bar screw anchors 5 on the guitar 18 in all cases wherein said guitar 18 has string stop bar screw anchors 5, ii) the two outer bridge attachment screws 4 on the guitar 18 wherein said guitar 18 has a bridge attachment screw 4 and does not have a screwed string stop bar screw anchor 5, and yet as another alternative with, iii) the bridge height adjustment screws 4 were the guitar 18 has a floating bridge 2 and does not have a screwed string stop bar screw anchor 5.

The vibrato unit 16 is then adequately attached to and minimally lifting/pressing on the front face 17 of the guitar 18 thereby consequently dampening vibration of the front face and sound box 17 in the guitar 18. Within this specification lifting/pressing is defined to mean lifting and/or pressing. The front face and sound box maximally vibrate thereby producing maximum resonance and depth of sound. The vibrato unit 16 is adequately secured to the guitar 18 without devaluing the guitar 18 by screwing to other than original screw attachment anchors 27 therein.

For purposes of further clarification only it is noted that guitars 18 having string stop bar screw anchors 5 are generally Gibson™ or known as Gibson™ style guitars. The bracket 20 used for these guitars 18 has a top portion as described in claim 1(c)(i). Guitars 18 having a bridge attachment screw 4 and not having a screwed string stop bar screw anchor 5, are generally Fender™ guitars or known as Fender™ style guitars. The bracket 20 used for these guitars 18 has a top portion as described in claim 1(c) (ii). There are numerous manufactures which use a floating bridge 2 and do not have a screwed string stop bar screw anchor 5. The bracket 20 used for these guitars 18 has a top portion as described in claim 1(c) (iii).

The broadest bracket claim described above can be narrowed with the following apparatus limitations. Most preferably the vibrato mounting bracket 20 comprises a plate. If the bracket 20 has a generally square turn 21 between the central 22 and bottom portion 24 thereof then a lower portion of the central portion 22 can be elevated above the front face 17 of the guitar 18 and so that the strings 13 thereby extend more parallel to the front face 17 of the guitar 18 and thereby apply minimal pressure thereon. In the most preferred embodiment of the invention the vibrato unit 16 is positioned on an upper portion of the central portion 22 of the bracket 20 to thereby maximize ease of operability of the arm assembly 6 thereon. It should be noted that conventional methods prefer to mount vibrato unit 16 towards the bottom portion of the guitar 18 thus sacrificing operability but thereby reducing face 17 dampening, and accordingly benefiting sound quality.

Another aspect of the invention comprises a vibrato mounting assembly 21 for producing vibrato on a guitar 18. The vibrato assembly 21 comprises: A) a frame portion 14 having carrying a lateral rotatable string anchoring member 8, and a tension arm assembly 6 to rotate the rotatable lateral member 8; and, B) a bracket 20 portion. The bracket 20 portion has a) a generally flat central portion 22 carrying and having the frame portion 14 attached thereto, said bracket portion 20 extending from a bottom peripheral edge of the guitar 18 along and over a front face 17 of the guitar 18, b) a bottom portion 24 extending from the central portion 22 over the bottom peripheral edge portion of the guitar 18 and having a lower strap screw attachment opening 24 therethrough; and, c) an upper portion 28 extending above the central portion 22 along the face 17 of the guitar 18 having two opposite lateral openings 30 therethrough.

As in the broadest bracket apparatus claim described above said openings 30 are spaced to align i) most preferably with one of the two outer string stop bar screw anchors 5 on the guitar 18, ii) alternatively with the two outer bridge attachment screws 3 on the guitar 18 where said guitar 18 has a bridge attachment screw 3 and does not have a string stop bar screw anchor 5, and yet as another alternative, iii) the bridge height adjustment screws 4 wherein the guitar 18 has a floating bridge 2 and does not have a string stop bar screw anchor 5. When the bracket 20 is attached to the guitar 18 by the lower shoulder strap attachment screw opening 26 the front face 17 of the guitar 18 is thereby minimally lifted/pressed and vibration on the front face 17 of the guitar 18 is consequently minimally dampened. The front face 17 and sound box 19 maximally vibrate thereby producing maximum resonance and depth of sound. And again, the vibrato unit 16 is adequately secured to the guitar 18 without devaluing the guitar 18 by screwing to other than original screw attachment anchors 27 therein.

A method of mounting a vibrato unit on a guitar comprising the steps of: a) providing a mounting bracket 20 as described above; b) attaching the vibrato unit 16 to the mounting bracket 20; and then, c) attaching the mounting bracket 20 to the guitar 18 by removing and replacing the lower shoulder strap mounting screw 23 on the guitar 18 and attaching an upper portion 28 of the mounting bracket 20 to the guitar 18 using one of i) the two outer string stop bar screw anchors 5 on the guitar 18 in all cases wherein said guitar 18 has a string stop bar screw anchors 5, ii) the two outer bridge attachment screws 3 on the guitar 18 where said guitar 18 has a bridge attachment screw 3 and does not have a string stop bar screw anchor 5, and yet as another alternative with, iii) the bridge height adjustment screws 4 where the guitar 18 has a floating bridge 2 and does not have a string stop bar screw anchor 5. Thereafter the guitar strings 13 are attached to the lateral lower rotatable string anchoring member 8. Finally, the guitar strings 13 are tightened. As above the vibrato unit 16 is adequately secured to the guitar 18 without devaluing the guitar 18 by screwing to other than original screw attachment anchors 27 therein. Minimal pressure is applied on the front face 17 of the guitar 18; and accordingly, the resonance and tone quality of the guitar 18 is greatly enhanced.

A method of producing vibrato on a guitar 18 comprises the steps of: providing a vibrato mounting assembly 21 as described above; attaching the mounting assembly 21 to the guitar 18 by removing and replacing the lower shoulder strap mounting screw 23 on the guitar 18 and attaching an upper portion of the assembly 21 to the guitar 18 using one of i) the two outer string stop bar screw anchors 5 on the guitar in all cases wherein said guitar 18 has a string stop bar screw anchor 5, ii) the two outer bridge attachment screws 3 on the guitar 18 where said guitar 18 has a bridge attachment screw 3 and does not have a string stop bar screw anchor 3, and yet as another alternative, iii) the bridge height adjustment screws 4 where the guitar 18 has a floating bridge 2 and does not have a string stop bar screw anchor 5. Thereafter the guitar strings 13 are attached to the lateral lower rotatable string anchoring member 8. Finally the guitar strings 13 are tightened. The vibrato assembly 21 is adequately secured to the guitar 18 without devaluing the guitar 18 by screwing to other than original screw attachment anchors 27 therein. Minimal pressure is on the front face 17 of the guitar 18 thereby greatly enhancing the resonance and tone quality of the guitar 18.

As the broadest bracket apparatus claim described above was limited by the apparatus limitations in the dependent claims thereafter; the vibrato assembly 21, and the independent method claims may similarly be narrowed by using the apparatuses as specified and described following the broadest apparatus claim.

While the invention has been described with preferred specific embodiments thereof, it will be understood that this description is intended to illustrate and not to limit the scope of the invention, which is defined by the following claims.

We claim:

1. A vibrato mounting bracket for mounting a vibrato unit on and above the front face of a guitar, said vibrato unit having a frame having mounting screw openings, a lateral lower rotatable string anchoring member, and a tension arm assembly to rotate the lateral rotatable member, said bracket comprising:

a) a generally flat central portion, said flat central portion having vibrato unit attachment openings therethrough positioned to align with the openings on the vibrato unit;

b) an upper portion extending above the central portion along the face of the guitar having two opposite lateral openings therethrough, said openings spaced to align and allow screws to be used in the same holes on the face of the guitar with one of i) the two outer string stop bar screws on the guitar in all cases wherein said guitar has a screwed string stop bar, ii) the two bridge attachment screws on the guitar where said guitar has a bridge attachment screw and does not have a screwed string stop bar, and yet as another alternative with, iii) the bridge height adjustment screws where the guitar has a floating bridge and does not have a string stop bar;

wherein the vibrato unit is adequately secured to the guitar without devaluing the guitar by screwing to other than original screw attachment anchors therein.

2. A vibrato mounting bracket as in claim 1 wherein the bracket comprises a plate.

3. A vibrato mounting bracket as in claim 1 further comprising a bottom portion extending from the central portion over the bottom peripheral edge portion of the guitar having a lower guitar attachment opening theretbrough, wherein the vibrato unit is adequately attached to and minimally lifts and/or presses on the front face of the guitar thereby minimally dampening vibration of the front face and sound box in the guitar; and, wherein the front face and sound box maximally vibrate thereby producing maximum resonance and depth of sound.

4. A vibrato mounting bracket as in claim 3 wherein the bracket comprises a plate.

5. A vibrato mounting bracket as in claim 4 wherein the mounting bracket has a generally square turn between the central and bottom portion thereof so that a lower portion of the central portion is elevated above the front face of the guitar and so that the strings thereby extend more parallel to the front face of the guitar and thereby apply minimal pressure thereon.

6. A vibrato mounting bracket as in claim 5 wherein the vibrato unit is positioned on an upper portion of the central portion of the bracket to thereby maximize operability of the arm assembly thereon.

7. A method of mounting a vibrato unit on a guitar comprising the steps of:

a) providing a mounting bracket as described in claim 4;

b) attaching the vibrato unit to the mounting bracket; and then, c) attaching the mounting bracket to the guitar by removing and replacing the lower shoulder strap mounting screw on the guitar and attaching an upper portion of the mounting bracket to the guitar using one of i) the two string stop bar screws on the guitar in all cases wherein said guitar has a screwed string stop bar, ii) the two outer bridge attachment screws on the guitar where said guitar has a bridge attachment screw and does not have a screwed string stop bar, and yet as another alternative with, iii) the bridge height adjustment screws were the guitar has a floating bridge and does not have a string stop bar; and thereafter, attaching the guitar strings to the lateral lower rotatable string anchoring member; and finally, tightening the guitar strings;

so that the vibrato unit is adequately secured to the guitar without devaluing the guitar by screwing to other than original screw attachment anchors therein and with application of minimal pressure on the front face of the guitar to thereby greatly enhancing the resonance and tone quality of the guitar.

8. A method as in claim 7 wherein the plate has a generally square turn between the central and bottom portion thereof so that a lower portion of the central portion is elevated above the front face of the guitar so that the strings thereby extend more parallel to the front face of the guitar and thereby apply minimal pressure thereon.

9. A method as in claim 8 wherein the vibrato unit is positioned on an upper portion of the central portion of the bracket to thereby maximize operability of the arm assembly thereon.

10. A method as in claim 8 wherein the plate has a generally square turn between the central and bottom portion thereof so that a lower portion of the central portion is elevated above the front face of the guitar and so that the strings thereby extend more parallel to the front face of the guitar and thereby apply minimal pressure thereon.

11. A method as in claim 10 wherein the vibrato unit is positioned on an upper portion of the central portion of the bracket to thereby maximize operability of the arm assembly thereon.

12. An assembly as in claim 1 wherein the plate has a generally square turn between the central and bottom portion thereof so that a lower portion of the central portion is elevated above the front face of the guitar so that the strings thereby extend more parallel to the front face of the guitar and thereby apply minimal pressure thereon.

13. A method of mounting a vibrato unit on a guitar comprising the steps of:

a) providing a mounting bracket as described in claim 11;

b) attaching the vibrato unit to the mounting bracket; and then, c) attaching the mounting bracket to the guitar by attaching an upper portion of the mounting bracket to the guitar using one of i) the two outer sting stop bar screws on the guitar in all cases wherein said guitar has a screwed string stop bar, ii) the two bridge attachment screws on the guitar where said guitar has a bridge attachment screw and does not have a screwed siring stop bar; and yet as another alternative with, iii) the bridge height adjustment screws were the guitar has a floating bridge and does not have a string stop bar; and thereafter, attaching the guitar strings to the lateral lower rotatable string anchoring member; and finally, tightening the guitar strings;

so that the vibrato unit is adequately secured to the guitar without devaluing the guitar by screwing to other than original screw attachment anchors therein.

14. A method as in claim 13 wherein the bracket comprises a plate.

15. A vibrato assembly for producing vibrato on a guitar comprising:

A) a frame portion carrying a lateral rotatable string anchoring member, and a tension arm assembly to rotate the lateral rotatable member; and, B) a bracket portion having a) a generally flat central portion carrying and having the frame portion attached thereto, said bracket portion extending along and over a front face of the guitar; and, b) an upper portion extending above the central portion along the face of the guitar having two opposite lateral openings therethrough, said openings spaced to align and allow screws to be used in the same holes on the face of the guitar with i) most preferably with one of the two outer string stop bar screws on the guitar, ii) alternatively with the two bridge attachment screws on the guitar where said guitar has a bridge attachment screw and does not have a screwed string stop bar, and yet as another alternative, iii) the bridge height adjustment screws where the guitar has a floating bridge and does not have a string stop bar; and, wherein the vibrato unit is adequately secured to the guitar without devaluing the guitar by screwing to other than original screw attachment anchors therein. --

16. An assembly as in claim 15 further comprising a bottom portion extending from the central portion over the bottom peripheral edge portion of the guitar having a lower guitar attachment opening therethrough; thereby facilitating minimal lifting and/or pressing on the front face of the guitar and maximal sound box vibration to produce maximum resonance and depth of sound.

17. A vibrato assembly as in claim 15 wherein the vibrato assembly is positioned on an upper portion of the central portion of the bracket portion to thereby maximize operability of the arm assembly thereon.

18. A method of producing vibrato on a guitar comprising the steps of providing a vibrato assembly as described in claim 15;

attaching the assembly to the guitar by removing and replacing a lower shoulder strap mounting screw on the guitar and attaching an upper portion of the assembly to the guitar using one of i) the outer string stop bar screws on the guitar in all cases wherein said guitar has a screwed suing stop bar, ii) the two outer bridge attachment screws on the guitar where said guitar has a bridge attachment screw and does not have a screwed string stop bar, and yet as another alternative, iii) the bridge height adjustment screws where the guitar has a floating bridge and does mot have a suing stop bar; and thereafter, attaching the guitar strings to the lateral lower rotatable string anchoring member; and finally, tightening the guitar strings;

so that the vibrato assembly is adequately secured to the guitar without devaluing the guitar by screwing to other than original screw attachment anchors therein.

* * * * *

US007709713C1

(12) EX PARTE REEXAMINATION CERTIFICATE (8867th)

United States Patent
Pearce et al.

(10) Number: US 7,709,713 C1
(45) Certificate Issued: Feb. 21, 2012

(54) MOUNTING PLATE AND VIBRATO ASSEMBLY FOR VIBRATO SYSTEM ON A GUITAR

(76) Inventors: Fred L. Pearce, Woodland Park, CO (US); Sherry L. Pearce, Woodland Park, CO (US)

Reexamination Request:
No. 90/009,827, Oct. 29, 2010

Reexamination Certificate for:

| | |
|---|---|
| Patent No.: | **7,709,713** |
| Issued: | **May 4, 2010** |
| Appl. No.: | **11/821,819** |
| Filed: | **Jun. 27, 2007** |

(51) Int. Cl.
*G10D 3/00* (2006.01)

(52) U.S. Cl. ..... 84/313; 84/299
(58) Field of Classification Search ..... None
See application file for complete search history.

(56) References Cited

To view the complete listing of prior art documents cited during the proceeding for Reexamination Control Number 90/009,827, please refer to the USPTO's public Patent Application Information Retrieval (PAIR) system under the Display References tab.

*Primary Examiner*—Jason Proctor

(57) ABSTRACT

A vibrato mounting bracket for a guitar, said vibrato unit having a frame having: a) a generally flat central portion extending from a bottom peripheral edge portion of the guitar, said flat central portion having four vibrato, unit attachment openings therethrough; b) a bottom portion extending from the central portion over the bottom peripheral edge portion of the guitar and having a lower strap screw attachment opening therethrough; and c) an upper portion extending above the central portion having two opposite lateral openings therethrough spaced to align with i) the two outer string stop bar screws on the guitar, or ii) the two outer bridge attachment screws on the guitar where said guitar has a bridge attachment screw, or iii) the bridge height adjustment screws. The front face and the sound box are then better able to vibrate thereby producing maximum resonance and depth of sound.

At the time of issuance and publication of this certificate, the patent remains subject to pending reissue application number 13/052,150 filed Mar. 21, 2011. The claim content of the patent may be subsequently revised if a reissue patent is issued from the reissue application.

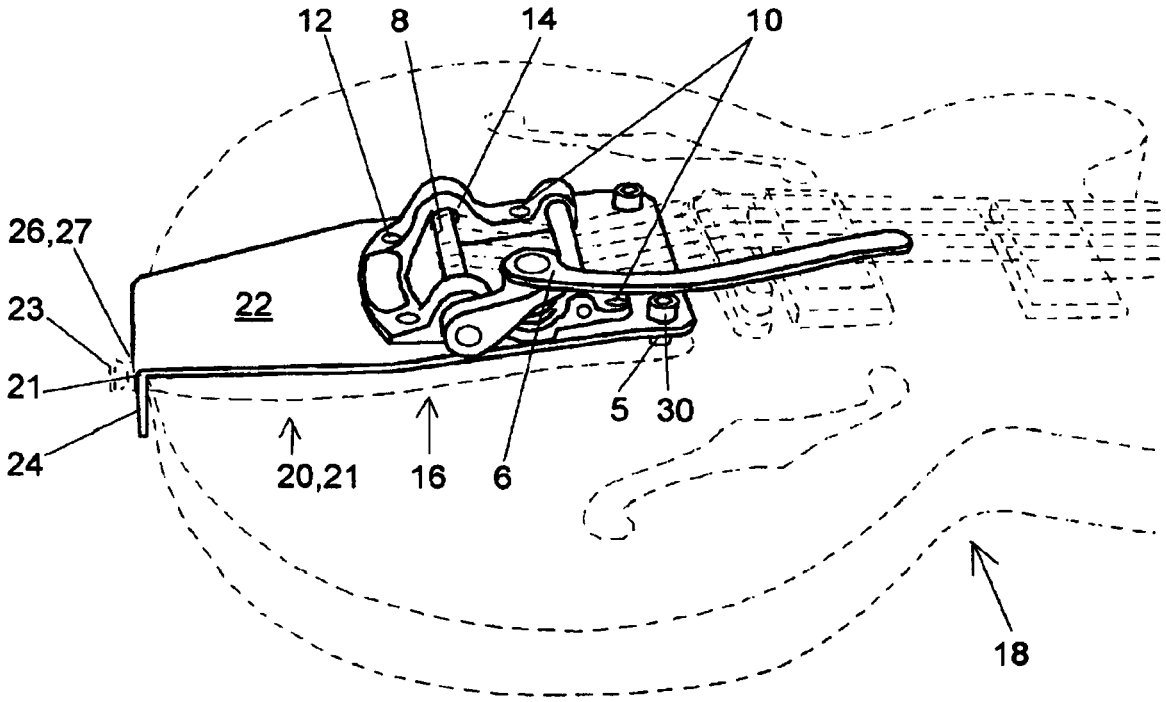

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-18 are cancelled.

* * * * *